US006272801B1

(12) United States Patent
Suh

(10) Patent No.: US 6,272,801 B1
(45) Date of Patent: Aug. 14, 2001

(54) DECORATIVE WINDOW ASSEMBLY

(76) Inventor: Jason Suh, 29701 Third Ave., Federal Way, WA (US) 98003

( * ) Notice: Subject to any disclaimer, the term of this patent is extended or adjusted under 35 U.S.C. 154(b) by 0 days.

(21) Appl. No.: 09/351,210

(22) Filed: Jul. 12, 1999

(51) Int. Cl.[7] ..... E06B 1/04

(52) U.S. Cl. ..... 52/211; 52/314; 52/455; 49/505

(58) Field of Search ..... 52/211, 212, 213, 52/214, 215, 216, 217, 204.53, 204.54, 204.56, 585.1, 204.61, 204.6, 455–457; 49/505, 63; 428/14

(56) References Cited

U.S. PATENT DOCUMENTS

| | | | | |
|---|---|---|---|---|
| 2,205,523 | * | 6/1940 | Galey | 49/63 |
| 2,666,234 | * | 1/1954 | Lester, Jr. | 49/63 |
| 2,853,161 | * | 9/1958 | Mascari . | |
| 3,084,737 | * | 5/1965 | Stevens | 49/63 |
| 3,184,801 | * | 3/1965 | Fletcher | 49/63 |
| 3,808,759 | * | 5/1974 | Carmichael | 52/212 |
| 3,943,662 | * | 3/1976 | LaRosa | 49/63 |
| 4,246,731 | * | 1/1981 | Miro | 52/204 |
| 4,430,831 | * | 2/1984 | Kemp | 52/211 |
| 4,542,051 | * | 9/1985 | Cirimele | 428/39 |
| 4,813,204 | * | 3/1989 | Rentschler | 52/217 |
| 4,972,640 | * | 11/1990 | DiFazio | 52/211 |
| 5,133,168 | * | 7/1992 | Neilly et al. | 52/585 |
| 5,233,802 | * | 8/1993 | Rogers | 52/212 |
| 5,369,922 | * | 12/1994 | Hansen | 52/204.54 |
| 5,418,021 | | 5/1995 | Kim . | |
| 5,491,936 | * | 2/1996 | Logan et al. | 52/105 |
| 5,609,937 | * | 3/1997 | Reinstad | 428/122 |
| 5,644,881 | * | 7/1997 | Neilly | 52/455 |
| 5,753,341 | * | 5/1998 | Peng | 428/122 |
| 5,901,768 | * | 5/1999 | Herbst | 49/63 |

* cited by examiner

*Primary Examiner*—Daniel P. Stodola
*Assistant Examiner*—Curtis A. Cohen
(74) *Attorney, Agent, or Firm*—David L. Tingey

(57) ABSTRACT

A prefabricated window fame with a decorative window subassembly within for use in a building having a window opening in a wall or a door with a rail about its perimeter. The window frame includes a first, or back, member and a second, or front, member overhanging the window subassembly therebetween and fastened together to form a window frame groove matching the window frame rail. The front frame member is mountable on the outside of the window opening and the back frame member is mountable on the inside of the window opening with the window subassembly therebetween. Frame members are identical, symmetric components with one when inverted matching another to comprise front and back frame members. The frame members are secured together by a plurality of fasteners secured to the frame members about their perimeters. The fasteners comprise matching latch hooks or posts with ridges matching frame holes with ridges. The window subassembly comprises a front window pane, a decorative rear window pane, a lattice panel sandwiched between the front window pane and the decorative rear window pane. The lattice panel includes a plurality of latticework elements simulating lead cames or glass solder, the latticework elements interconnecting to define a plurality of open holes in the lattice panel providing visually unobstructed view to the decorative rear window pane and thermal air pockets.

19 Claims, 7 Drawing Sheets

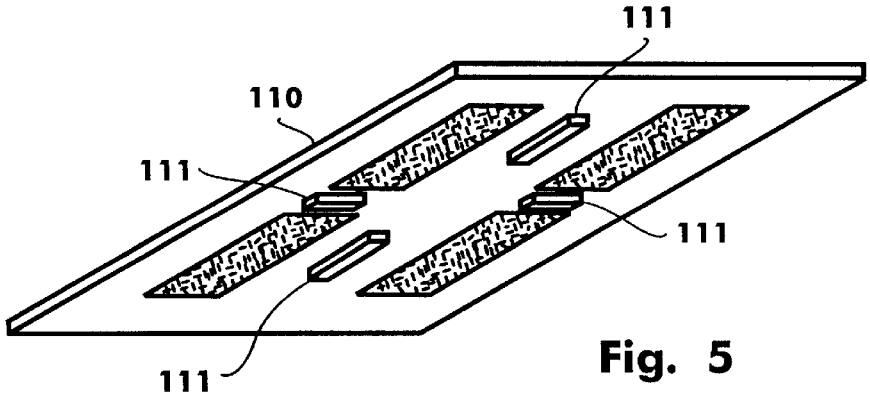
Fig. 5
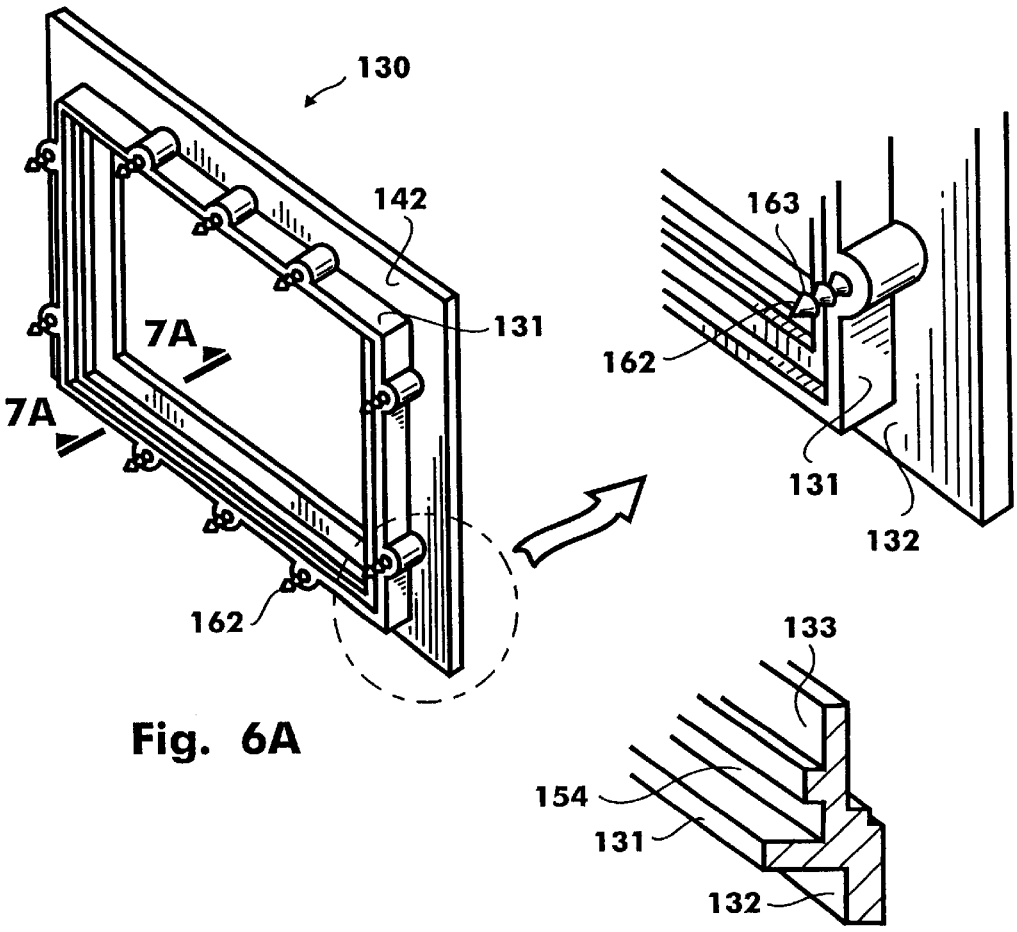
Fig. 6A
Fig. 7A

DECORATIVE WINDOW ASSEMBLY

BACKGROUND

1. Field of the Invention

This invention relates to decorative window panes, and more particularly to prefabricated decorative window assembly of glass or plastic panes sandwiching a single panel simulating a lattice of cames typical of traditional leaded glass panes within a window frame configured for installation in a building wall or door window opening.

2. Prior Art

Windows of latticework or stained glass are common. The window characteristically is handmade of stained window pieces joined into a panel by cames of lead or other soft metal. The time required of skilled labor to fabricate such decorative windows makes them relatively expensive. Such windows generally are also susceptible to breakage and provide poor thermal insulation. Further, repair of a broken glass piece in such a pane requires replacement of the piece by securing a new piece in the pane with new cames or solder. This requires a skilled worker at the site of installation of the window, again a cost concern. There have been attempts to substitute traditional decorative glass with less costly plastic windows but they have found limited commercial success because such windows generally do not look and feel like real glass. Other attempts to replace traditional cames with plastic lattice frames also have met with problems.

For example, Kim, U.S. Pat. No. 5,418,021, attempts to overcome these disadvantages with a tinted-glass window assembly employing an inner frame that simulates a lattice of lead cames into which a plurality of individual glass or plastic pieces are inserted at a factory, making the assembled window less expensive to construct and less expensive to repair. The inner frame is then sandwiched between glass panes to provide the look of an actual tinted glass window. The Kim window was an improvement but still required a comparatively expensive assembly of glass or plastic pieces in the lattice frame between glass panes and resulted in a window that was relatively heavy, still relatively labor intensive in its construction and subject to breakage during manufacture, shipping, and assembly.

SUMMARY OF THE INVENTION

It is the object of this invention to provide a window of simulated etched or tinted glass in panes or panels in a window frame suitable for installation in a building. This object is achieved in an assembly of three window panes or panels including an inner lattice panel simulating a network of lead. The window is assembled from an inventory of identical mass-produced components by simple and quick stacking of panels that extend across a window frame. The window frame is of building construction quality and design and suitable for installation in a building as a prebuilt window. Thus, it can be mass-produced at a low cost and installed during building construction or substituted for an existing frame by removing the existing frame intact with its glass and replacing it with the present decorative window.

The window comprises a first outside pane of tempered glass so it is inherently strong, safe and weatherproof. A lattice panel comprising a latticework of elements simulating lead cames or solder but without glass pieces in the latticework as in prior window assemblies. A third pane or panel typically of colored, etched or otherwise decorative plastic mounts over the lattice panel providing an appearance of tinted or etched glass. Thus, the first or front pane is spaced apart from the third or back pane in parallel relation by the lattice panel sandwiched between. Because the middle lattice panel has no glass pieces but only air pockets created between the front and back panes and contained with minimal convection by the latticework elements, the window provides favorable thermal insulation.

The lattice panel and the rear decorative pane are registered by tongues in the rear decorative pane fitting into grooves in the lattice panel. Or, equivalently, tongues in the lattice panel could fit into grooves in the rear pane. In this manner, the rear decorative panel, which might comprise a plurality of different colors or patterns changing at the latticework is registered with the lattice panel.

The window is assembled by stacking the panes in shelves on front and back window frame members, respectively. The sandwiched lattice panel extends beyond the front and back panes with lattice panel ridges fitting into a channel in each of the frame members with the panes resting against the lattice panel on a perimeter border. The frame members are identical with one inverted to match the other during assembly. Thus, reducing the cost of molds and inventory needs reduces the cost of production of the window frame significantly. The window frame members are secured together either by screws or a fastener means which allows the frames to snap together, again reducing the time to assemble.

The window frame can optionally be assembled without adhesive bonding between the several elements, in which case, the window frame can be disassembled by simply removing the screws or urging the fasteners apart., Because of the ease of assembly and disassembly, the rear pane can be replaced conveniently to achieve a different decorative look. Similarly, the lattice panel can be easily replaced to obtain a new decorative appearance. Also, for replacement of a broken front glass pane—the only glass member, the frame is similarly quickly disassembled and reassembled.

In this manner, though the window is assembled from mass-produced parts at a factory, the window appears to be hand-made stained glass or latticework held together in lead cames. It has a front solid glass pane easily replaceable as with other windows and which gives the advantages and appearance of a glass window. Its single decorative plastic back pane provides an artistic contribution to the window in a single pane extending across the window, substituting for a plurality of plastic or glass pieces within a latticework of cames or simulated cames. The single-piece decorative element of the window is low cost, easy to assemble and easy to replace, and by substituting the rear pane, one achieves a new and different window effect or appearance. The window is relatively low cost and lightweight, yet sturdy and has the convenience of a traditional preassembled window.

BRIEF DESCRIPTION OF THE DRAWINGS

FIG. 5 is a perspective view of the underside rear decorative pane as it would fit over the lattice panel of FIG. 4*b*.

FIG. 6*a* is a perspective view of the frame showing a ridged post fastener.

FIG. 7*a* is a cross-sectional perspective view of a frame member along the line of 7*a*—7*a* of FIG. 6*a* showing a perimeter channel and perimeter shelf.

DETAILED DESCRIPTION OF THE PREFERRED EMBODIMENT

Figure 1:
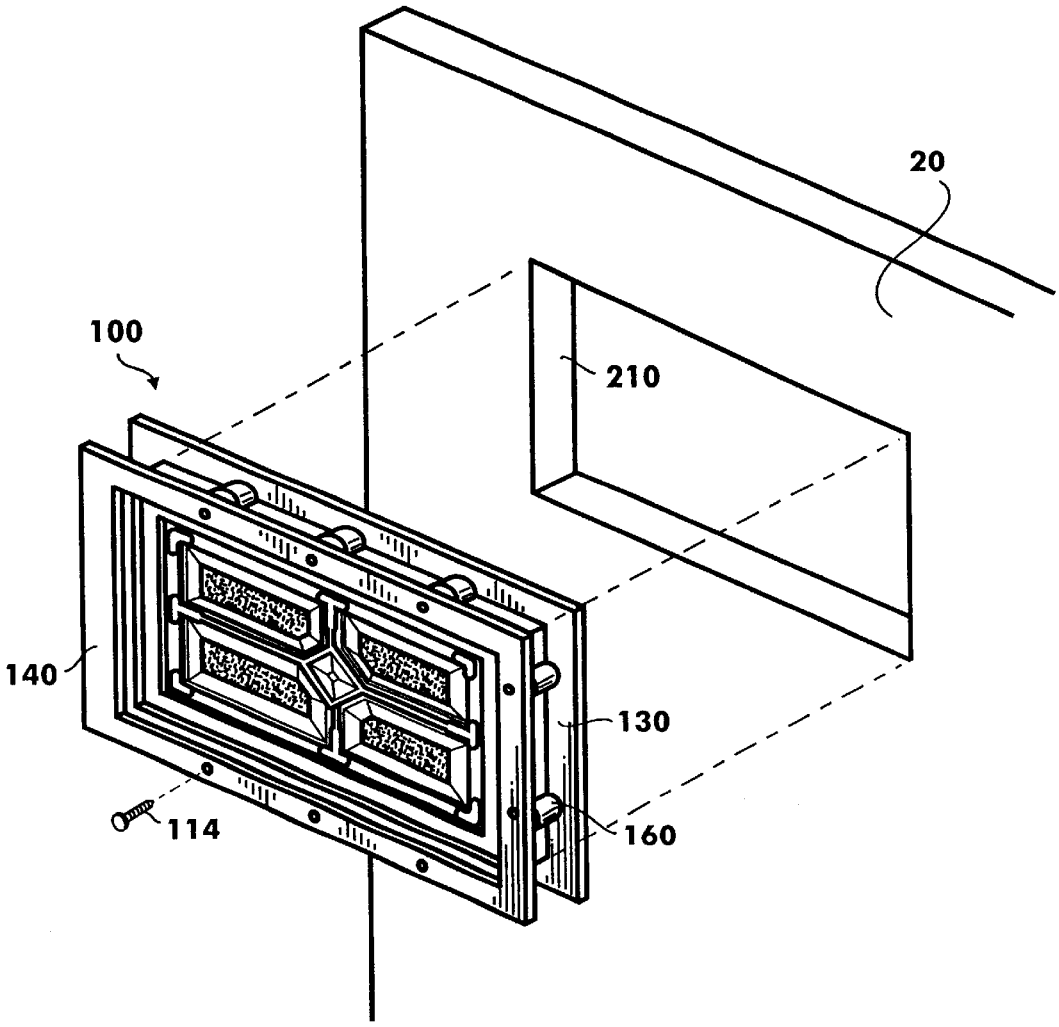
FIG. 1 is a perspective view of an assembled three-layered glass window having an inner lattice panel sandwiched between outer panes suitable for installation in a wall or door window opening.
Figure 2:
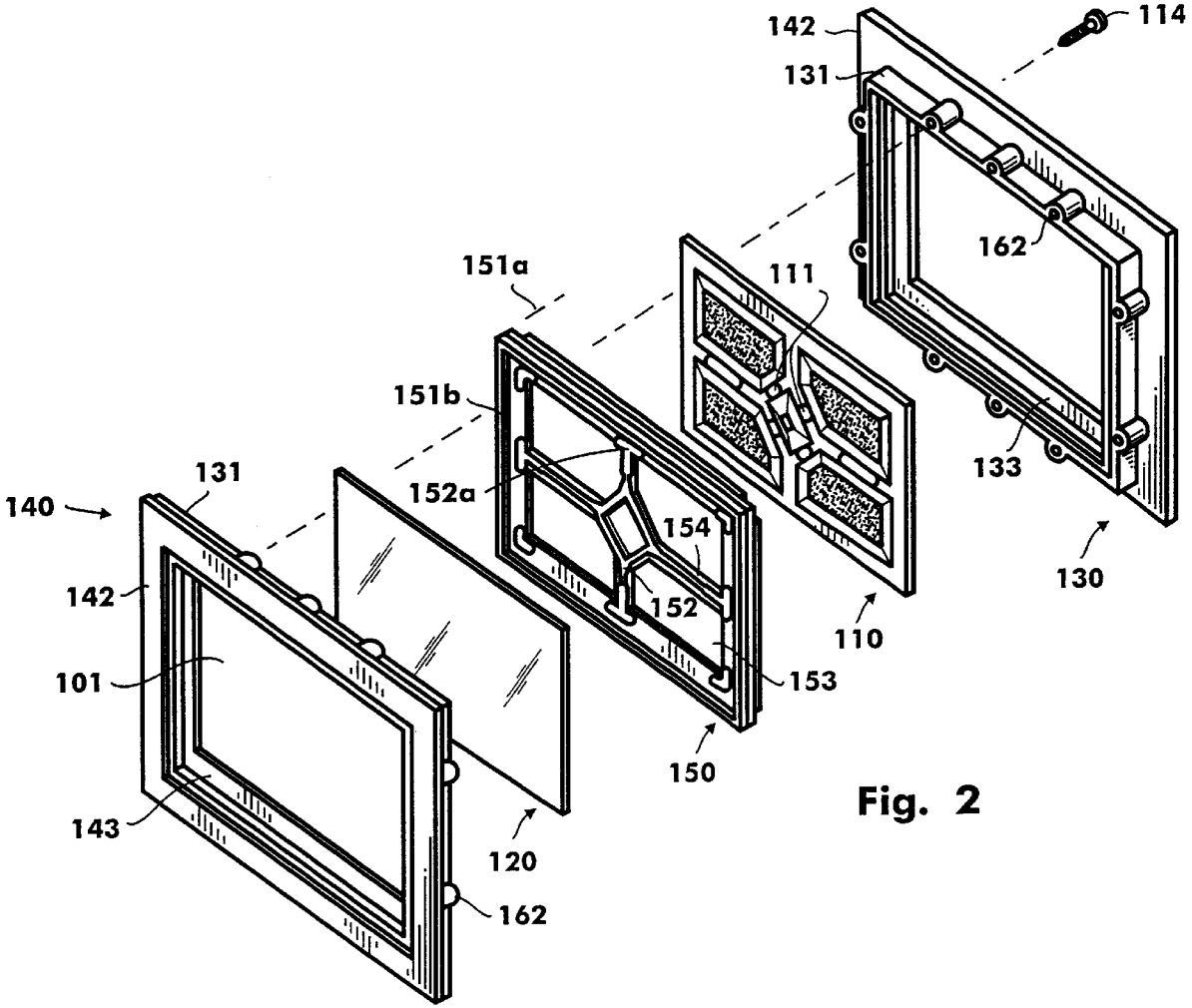
FIG. 2 is au exploded perspective view of the window of FIG. 1.
Figure 3:
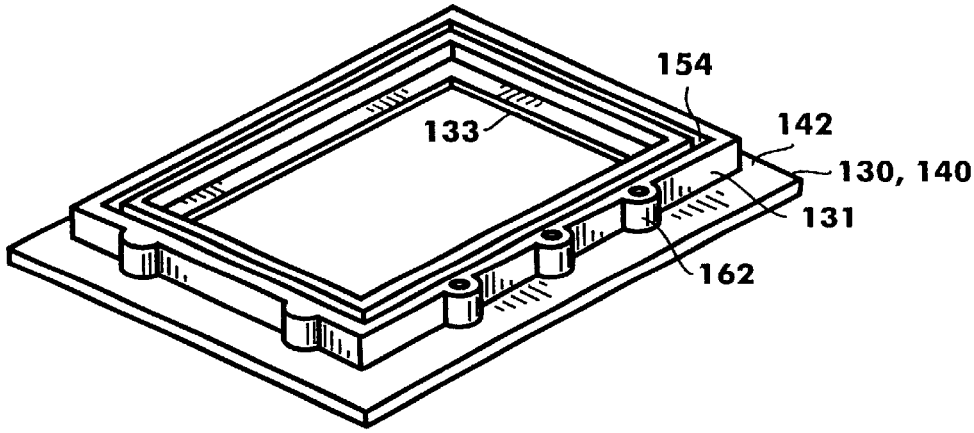
FIG. 3 is a perspective view ofthe frame.
Figure 4A:
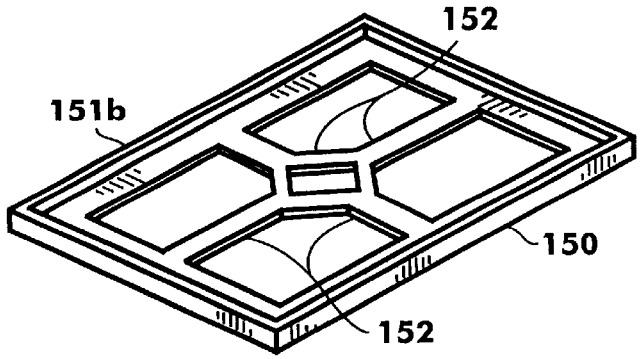
FIG. 4*a* and FIG. 4*b* are perspective views of the lattice panel front and back sides, respectively.
Figure 4B:
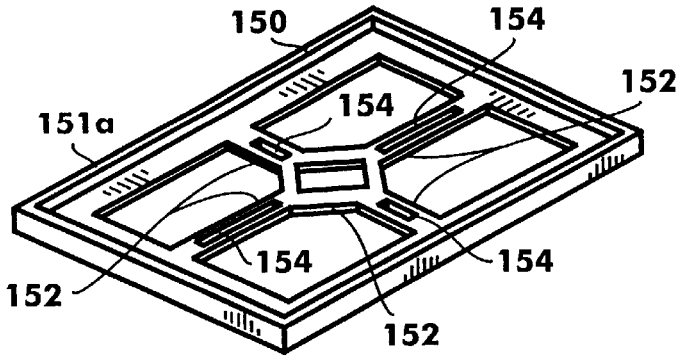
Figure 6B:
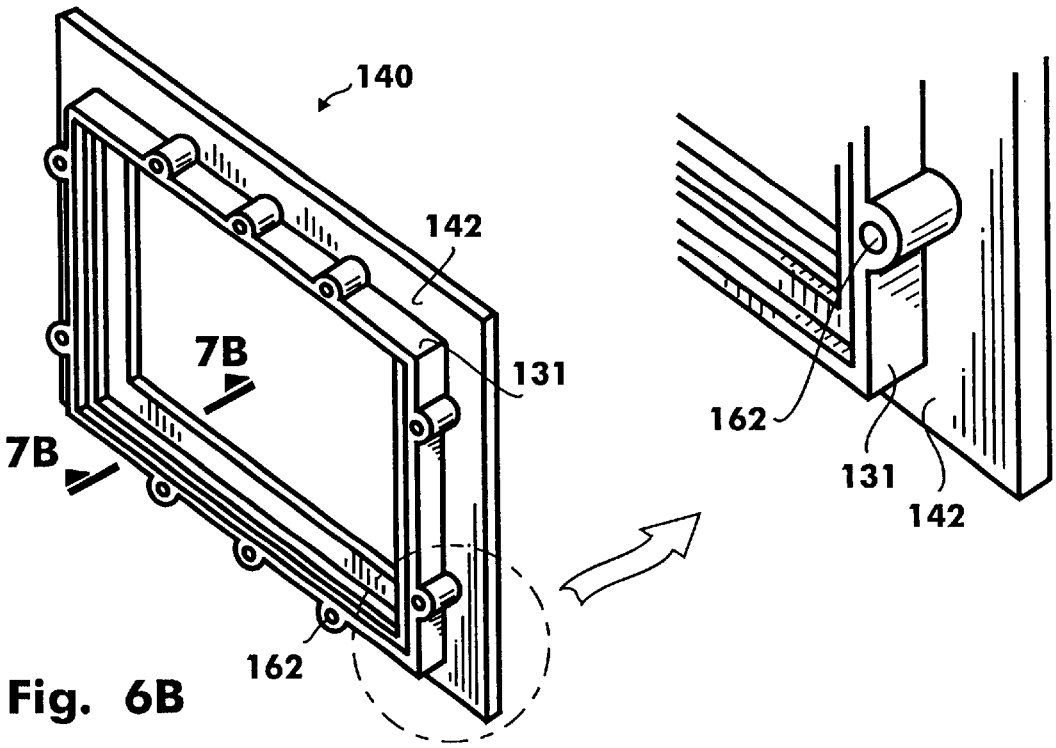
FIG. 6*b* is a perspective view of the matching frame showing a plurality of frame bores with matching ridges for receiving the post fastener.
Figure 7B:
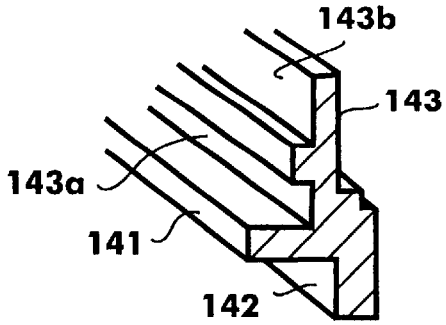
FIG. 7*b* is a cross-sectional perspective view of a frame member along the line 7*b*—7*b* of FIG. 6*b* showing a perimeter channel and perimeter shelf.
Figure 9A:
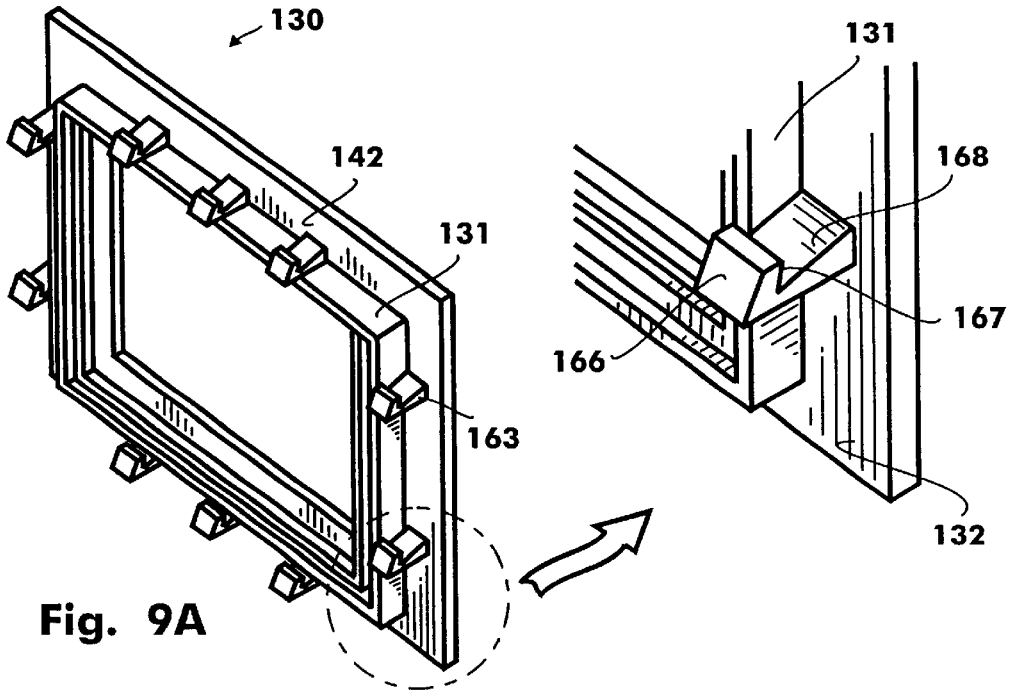
FIG. 9*a* is a perspective view of the frame showing a plurality of lower latch hooks.
Figure 9B:
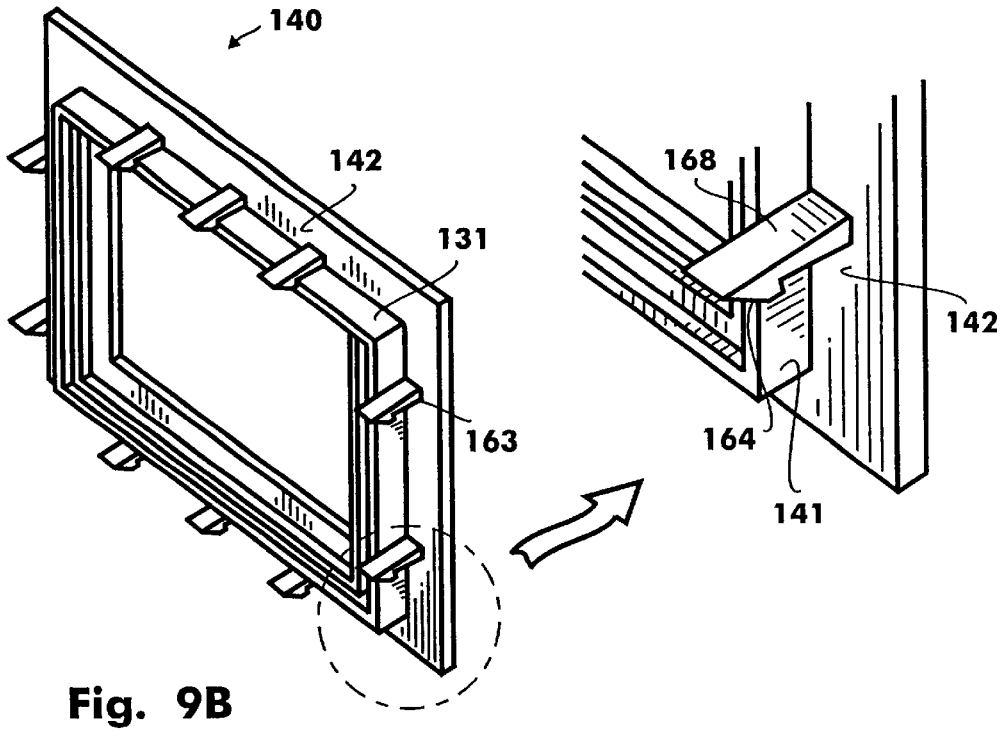
FIG. 9*b* is a perspective view showing a plurality of frame upper latch hooks with matching lower latch hooks for receiving the upper latch hooks.
Figure 8:
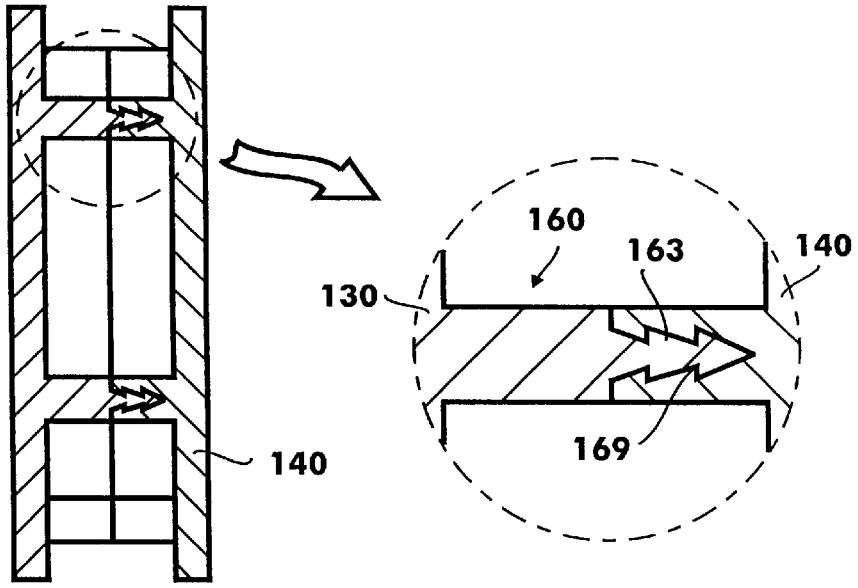
FIG. 8 is a cross-sectional end view showing the post fastener secured in a matching bore.
Figure 10:
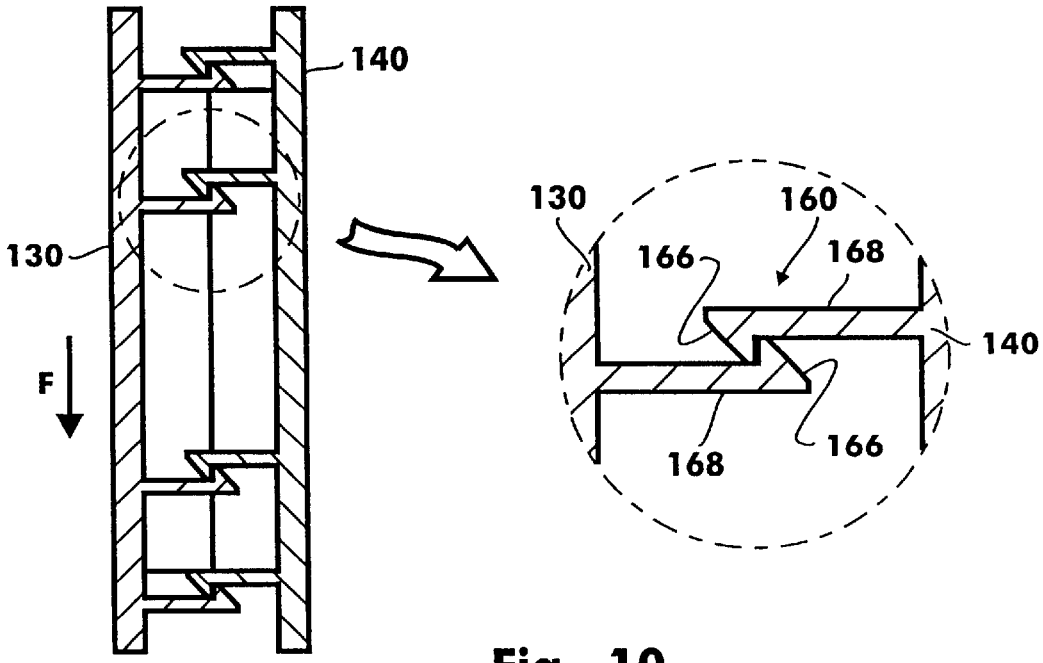
FIG. 10 is a cross-sectional end view showing the upper latch hook secured in to a matching lower latch hook.

The window assembly of the present invention is configured to fit as a prefabricated window into a window opening in a building wall or a door 20 having a rail 210 for receiving a groove 102 of window frame. Referring to the Figures, the window assembly includes front pane 120, typically of glass, and a back pane 110, typically of decorative plastic. A lattice panel 150, sandwiched between the front and back panes, has frontward and rearward extending ridges 151*b* and 151*a*, respectively, at its sides for securing itself to a frame and further comprises a latticework of lattice elements 152 simulating window cames. The lattice elements divide the lattice panel into a plurality of openings 153. With the front and back panes covering the lattice panel openings they become air pockets with restricted air movement that enhances thermal insulation of the window.

In the lattice elements 152 are a plurality of grooves 154 useful for registering the panel in the frame. A window frame 100 with a center opening 101 is configured to surround and receive the assembly of panel and panes in its center opening. The window frame 100 has a front member 130 and a back member 140 in face-to-face contact. Typically, the front frame member and back frame member are identical symmetric components such that one inverted member is a mirror image of the other and match each other as front and back frame members.

The frame members 130 and 140 each include a face member 142 from which housing 131 is recessed bounding the frame center opening 101. In the each housing 131 is a channel 132 and a shelf 133 around the housing, the shelves being inward of the channels and opening to the frame center opening.

The front pane 120 rests on the front member shelf 133. The lattice panel 150 then sits rearward over the front pane 120 with its frontward extending ridges 151*b* fitting in the front member channel 132. The glass front pane 120 is then secured on the shelf 133 by the lattice panel 150. The back pane 110 comprises a plurality of tongues 111 located and sized to match and fit in the grooves 154 of the lattice elements 152. It fits over the lattice panel 150 with the tongues 11 respectively fitting in the grooves 154 to register the decorative back pane with the lattice panel. With the back pane thus registered on the lattice panel, the back pane is uniformly apart from the lattice panel ridges. The frame back member 130 then fits over the back pane with rearward directed pane ridges 151*a* fitting in frame back member channel 132 and the back pane 110 fitting on the frame back member shelf 133.

When the frame front and back members are thus secured together, the face members 142 of the frame members 130 and 140 are separated by the joined housings 131 forming the groove 102 which is mountable over on the window opening rail 210 with the front and back panes and the lattice panel sandwiched between secured in the frame housing 131.

The frame and back members in a first embodiment are secured together by a plurality of screws 114 passing from one into the other. It may be advantageous to avoid the exposure of the screw heads and the time in assembly required to install several screws about the frame, in which case the frame members are attached by a plurality of fasteners secured to the frame members about its perimeter that allows the frame members to snap together without use of screws. In a first alternative embodiment, the fastener comprises a latch hook 163 with a generally hook head 164 on a distal end of a resilient leg 168 with a head slanted side 166 facing outward from the frame member to which it is attached and a hook catch side 167 facing inward toward its frame member. Typically, all hooks are oriented similarly around the frame and symmetrically so that when a first frame member is inverted, the hooks are aligned in opposition to a second frame member. Thus, when the frame members are urged together, the hook slanted sides meet. When further urged together, the hook legs bend slightly as the hook slanted sides slide on each other until they pass, allowing the resilient leg to spring back into normal position with the head catch sides of the hooks engaged.

In a second embodiment, the fastener comprises a post 162 with circumferential ridges 163 along its length and a bore 165 in said frame member that also includes a plurality of circumferential ridges 169 staged along its depth matching the post and post ridges. Similar to the first embodiment, the holes are arranged on the frame member symmetrically so that when a first frame member is inverted, the bores are aligned in opposition to a second frame member. The frame members are joined together by placing ends of the post in matching bores of two frame members and urging the frame members together causing the post ridges to engage the bore ridges in the two frame members. Equivalently, one end of the post may be anchored in bores of one frame before its other end is urged into a bore of a matching hole of an opposing frame, or constructed with the post integral with the frame.

It is clear that certain materials can be substituted for those described, such as plastic for glass, and different but equivalent implementations of the invention can be employed without changing the import of this described invention. It is the intention that such substitutions and equivalent embodiments be included in this disclosed invention.

Having described the decorative window assembly, what I claim is as follows:

1. A decorative window assembly comprising a front window pane, a decorative rear window pane, a lattice panel sandwiched between the front window pane and the decorative rear window pane, the lattice panel comprising a plurality of latticework elements having the appearance of lead cames or glass solder, the latticework elements interconnecting to define a plurality of open holes in the lattice panel providing visually unobstructed view to the decorative rear window pane, the front window pane, the decorative rear window pane, and the lattice panel defining a window pane subassembly, a window frame with a frame center opening, the frame around the perimeter of the window pane subassembly with the window pane subassembly filling the frame center opening.

2. The decorative window assembly of claim 1 in which the window frame comprises a front frame member and a back frame member configured to secure the window pane subassembly therebetween, a fastener means for securing the front frame member to the back frame member.

3. The decorative window assembly of claim 2 wherein the fastener means comprises a plurality of fasteners secured to the frame members about their perimeters wherein each said fastener comprises a latch hook including a resilient leg attached to a frame member and a hook head on its distal end with a head slanted side facing outward from the frame member to which it is attached and a hook catch side facing inward toward its frame member.

4. The decorative window assembly of claim 3 wherein all of said hooks are oriented similarly symmetrically around the frame so that when a first frame member is inverted, the hooks of the first frame member are aligned in opposition to a second frame member such that when the frame members are urged together, the respective hook slanted sides meet and the resilient hook legs bend slightly as the hook slanted sides slide on each other pushing the hooks apart until they pass, allowing the resilient leg to spring back into initial position as the head catch sides of the hooks engage.

5. The decorative window assembly of claim 2 wherein the fastener means comprises a plurality of posts, each post with at least one transverse circumferential ridge protruding radially outward along its length and wherein said front and back frame members each have a plurality of bores in a frame member portions symmetrically around each frame so that when a first frame member is inverted, the first frame member bores are axially aligned with respective bores in said second frame member, which bores each include a plurality of transverse circumferential ridges protruding radially inward and staged along its depth matching the post and post ridges such that the frame members may be joined together by placing ends of the post in matching bores of two frame members and urging the frame members together therein causing the post ridges to engage the bore ridges in the two frame member portions.

6. The decorative window assembly of claim 2 wherein each frame member further comprises a front member channel around the frame, a front member shelf around the frame and inward of the front member channel and opening to the frame center opening, the front pane resting on the front member shelf, the lattice panel being rearward over the front pane with its frontward extending ridges fitting in the front member channel, the glass pane being secured in the frame on the front member shelf by the lattice panel, a back member channel around the frame, a back member shelf around the frame and inward of the back member channel and opening to the frame center opening, the rear window pane resting on the back member shelf, the back frame member being rearward of the rear pane with the lattice panel rearward extending ridges fitting in the rear member channel, the rear pane being secured in the rear frame member on the rear member shelf by the rear frame member.

7. The decorative window assembly of claim 6 wherein the lattice panel fills the frame center opening and has forward-extending ridges and rearward-extending ridges around its perimeter configured to receive the front pane on its front side and the rear window pane on its back side, the front pane and the rear window pane both filling the frame center opening, the panes spaced apart from the ridges slightly to form a groove, the forward-extending ridges fitting into the frame front member channel and the rearward-extending ridges fitting into the frame back member channel.

8. The decorative window assembly of claim 7 wherein the rear window pane includes a plurality of tongues and in which the lattice panel latticework elements has a matching plurality of grooves for receiving the plurality of tongues, respectively, configured to register the decorative rear window pane with the lattice panel such that with the back pane thus registered on the lattice panel, the rear window pane is uniformly spaced apart from the lattice panel ridges suitable for receiving the frame front member and frame rear member, respectively.

9. The decorative window assembly of claim 1 wherein the rear window pane includes a plurality of tongues and in which the lattice panel latticework elements has a matching plurality of grooves for receiving the plurality of tongues, respectively, configured to register the decorative rear window pane with the lattice panel.

10. A decorative window assembly comprising a front window pane, a decorative rear window pane including integral sections of displays, a lattice panel sandwiched between the front window pane and the decorative rear window pane, the lattice panel comprising a plurality of latticework elements simulating cames, the latticework elements interconnecting to define a plurality of openings in the lattice panel providing visually unobstructed view to the sections of displays of the decorative rear window pane, the front window pane, the decorative rear window pane, and the lattice panel defining a window pane subassembly, the latticework elements configured to divide and bound the sections of displays as viewed from the window front therein providing an appearance of glass pieces fit together by lead cames or glass solder while providing air pockets within respective lattice panel openings that enhance thermal insulation properties of the assembly, a window frame around the perimeter of the window pane subassembly, the window pane subassembly filling an open frame center area bordered by the window frame.

11. The decorative window of claim 10 in which the window frame comprises a front frame member and a back frame member, and means for joining said frame members together with the window pane subassembly within the frame opening.

12. The decorative window of claim 11 in which the means for joining said frame members together is adhesive-free with fasteners that snap together.

13. The decorative window of claim 12 wherein the fastener means comprises a plurality of fastenes secured to the frame members about their perimeters wherein each said fastener comprises a latch hook including a resilient leg attached to a frame member and a hook head on its distal end with a head slanted side facing outward from the frame member to which it is attached and a hook catch side facing inward toward its frame member.

14. The decorative window assembly of claim 13 wherein all of said hooks are oriented similarly symmetrically around the frame so that when a first frame member is inverted, the hooks of the first frame member are aligned in opposition to a second frame member such that when the frame members are urged together, the respective hook slanted sides meet and the resilient hook legs bend slightly as the hook slanted sides slide on each other pushing the hooks apart until they pass, allowing the resilient leg to spring back into normal position as the head catch sides of the hooks engage.

15. The decorative window assembly of claim 12 wherein the fastener means comprises a plurality of posts, each post with at least one transverse circumferential ridge protruding radially outward along its length and wherein said front and back frame members each have a plurality of bores in a frame member portions symmetrically around each frame so that when a first frame member is inverted, the first frame member bores are axially aligned with respective bores in said second frame member, which bores each include a plurality of transverse circumferential ridges protruding radially inward staged along its depth matching the post and post ridges such that the frame members may be joined together by placing ends of the post in matching bores of two frame members and urging the frame members together therein causing the post ridges to engage the bore ridges in the two frame member portions.

16. The decorative window of claim 11 in which said frame members are identical components in which one is inverted to form a matching member with the other as the two members are joined.

17. A prefabricated window frame with a decorative window subassembly within for use in a wall or a door having a window opening with a rail about its perimeter to receive said prefabricated window frame with said decorative window subassembly within, said window frame including a groove about its perimeter adapted to fit on the window opening rail, said window frame further comprising a first, or back, member and a second, or front, member overhanging the window subassembly therebetween and fastened together to form said window frame groove, the front frame member mountable on the outside of the window opening and the back frame member mountable on the inside of the window opening with the window subassembly therebetween, said window subassembly further comprising a front window pane, a decorative rear window pane, a lattice panel sandwiched between the front window pane and the decorative rear window pane, the lattice panel comprising a plurality of latticework elements simulating lead cames or glass solder, the latticework elements interconnecting to define a plurality of open holes in the lattice panel providing visually unobstructed view to the decorative rear window pane and thermal air pockets.

18. The prefabricated window frame of claim 17 in which the decorative rear window pane comprises color designs.

19. The prefabricated window frame of claim 17 in which the decorative rear window pane comprises design surface patterns having an appearance of etched glass.

* * * * *